US010151182B2

(12) United States Patent
Wilkins et al.

(10) Patent No.: US 10,151,182 B2
(45) Date of Patent: Dec. 11, 2018

(54) MODULAR TOP LOADING DOWNHOLE PUMP WITH SEALABLE EXIT VALVE AND VALVE ROD FORMING APERTURE

(71) Applicant: Samson Pump Company, LLC, Porter, OK (US)

(72) Inventors: Brad Wilkins, McAlester, OK (US); Truman Replogle, Porter, OK (US); Howard Blankenship, Red Oak, OK (US)

(73) Assignee: Samson Pump Company, LLC, Tulsa, OK (US)

( * ) Notice: Subject to any disclaimer, the term of this patent is extended or adjusted under 35 U.S.C. 154(b) by 312 days.

(21) Appl. No.: 14/848,848

(22) Filed: Sep. 9, 2015

(65) Prior Publication Data

US 2015/0376995 A1 Dec. 31, 2015

Related U.S. Application Data

(63) Continuation-in-part of application No. 13/773,826, filed on Feb. 22, 2013, now Pat. No. 9,157,301.

(51) Int. Cl.

| | |
|---|---|
| ***E21B 43/12*** | (2006.01) |
| ***E21B 34/06*** | (2006.01) |
| ***E21B 47/00*** | (2012.01) |

(52) U.S. Cl.

CPC ..... *E21B 43/121* (2013.01); *E21B 34/063* (2013.01); *E21B 43/127* (2013.01); *E21B 47/0008* (2013.01); *E21B 43/12* (2013.01)

(58) Field of Classification Search

CPC ..... E21B 34/14; E21B 34/12; E21B 43/12; E21B 43/121; E21B 43/127

See application file for complete search history.

(56) References Cited

U.S. PATENT DOCUMENTS

| | | | | |
|---|---|---|---|---|
| 1,578,720 A | | 3/1926 | Derby | |
| 1,900,588 A | * | 3/1933 | Scott | F04B 47/00 417/450 |
| 2,146,328 A | * | 2/1939 | Collins | F04B 49/10 417/503 |
| 2,567,513 A | * | 9/1951 | Haines | E21B 43/12 166/62 |

(Continued)

*Primary Examiner* — Jennifer H Gay

(74) *Attorney, Agent, or Firm* — Margaret S. Millikin

(57) ABSTRACT

A method and apparatus for improving the production efficiency of a well and preventing gas lock. The apparatus is a downhole pump and comprises a barrel, a reciprocating plunger and a body having a plurality of inlet valves. The apparatus does not require outlet valves. The body and inlet valves are positioned above the barrel and plunger, thus eliminating gas lock. Fluids enter the body through the valves and, during upstrokes of the plunger, are forced up the tubing string to the surface equipment. Modularity of the components permits pump components to be changed as the productivity of the well fluctuates and also allows production of more fluids with a smaller casing. The invention prevents gas lock by permitting gasses to escape between a sliding valve and a valve rod connected to the plunger. Additionally, an exit valve sealably engages the valve rod, which forms an aperture. During operation of the pump, the gasses escape through the aperture in the valve rod and rise up the tubing string.

29 Claims, 8 Drawing Sheets

(56) References Cited

U.S. PATENT DOCUMENTS 2,688,928 A * 9/1954 Vincent ..... F04B 47/12 166/193
2,704,980 A * 3/1955 Vincent ..... E21B 43/122 166/153
3,046,904 A * 7/1962 Crow ..... F04B 53/16 166/106
3,090,316 A * 5/1963 Montgomery ..... F04B 47/04 166/372
3,175,514 A * 3/1965 McMurry ..... E21B 43/122 137/155
3,479,958 A * 11/1969 Anderson ..... F04B 47/00 417/437
3,575,194 A * 4/1971 McMurry ..... E21B 43/123 137/155
3,765,482 A * 10/1973 Harrison ..... E21B 43/127 166/106
3,773,437 A 11/1973 Suman, Jr.
3,809,162 A * 5/1974 Sydor ..... E21B 23/00 166/377
3,861,471 A 11/1975 Douglas
4,049,365 A * 9/1977 Sparks, Sr. ..... E21B 43/127 417/554
4,211,279 A * 7/1980 Isaacks ..... E21B 33/068 166/106
4,386,653 A 6/1983 Drake
4,397,612 A * 8/1983 Kalina ..... E21B 43/122 417/108
4,405,291 A * 9/1983 Canalizo ..... E21B 43/121 417/393
4,407,362 A * 10/1983 Bechthold ..... E21B 23/03 166/117.5
4,410,038 A * 10/1983 Drapp ..... E21B 43/121 166/53
4,643,258 A 2/1987 Kime
4,741,679 A 5/1988 Blassingame
4,968,226 A 11/1990 Brewer
5,005,651 A * 4/1991 Burrows ..... E21B 23/02 166/109
5,104,301 A 4/1992 Brewer
5,249,936 A 10/1993 McConnell et al.
5,497,832 A * 3/1996 Stuebinger ..... E21B 43/127 166/106
5,915,478 A * 6/1999 Brown ..... E21B 34/08 166/329
6,142,224 A * 11/2000 Stuebinger ..... E21B 41/0057 166/105.5
6,273,690 B1 8/2001 Fischer et al.
6,323,690 B1 11/2001 Kennedy et al.
6,537,042 B1 * 3/2003 Lundback ..... F04B 47/02 417/547
6,651,740 B2 11/2003 Kobylinski et al.
6,886,636 B2 5/2005 Michael et al.
6,945,762 B2 9/2005 Williams
7,458,787 B2 12/2008 Brown
7,604,464 B2 10/2009 Williams
8,303,727 B2 11/2012 Pugh et al.
9,316,222 B2 * 4/2016 Strahov ..... F04B 49/22
2005/0053503 A1 3/2005 Gallant
2005/0226752 A1 * 10/2005 Brown ..... F04B 47/02 417/555.1
2007/0000663 A1 * 1/2007 Kelley ..... E21B 43/121 166/268
2008/0240930 A1 * 10/2008 Palka ..... E21B 43/127 417/42
2008/0247893 A1 10/2008 Perkins et al.
2010/0147514 A1 6/2010 Swaringin
2010/0252271 A1 * 10/2010 Kelley ..... E21B 43/122 166/370
2010/0294506 A1 * 11/2010 Rodriguez ..... E21B 43/121 166/372
2013/0195702 A1 * 8/2013 Strahov ..... F04B 47/00 417/534
2013/0319695 A1 * 12/2013 Krawiec ..... E21B 34/14 166/387
2014/0238688 A1 * 8/2014 Blankenship ..... E21B 43/121 166/369
2015/0376995 A1 * 12/2015 Wilkins ..... E21B 43/063 166/372
2015/0376996 A1 * 12/2015 Downing ..... F04B 47/02 417/514
2016/0230517 A1 * 8/2016 Wessel ..... E21B 43/12
2017/0058635 A1 * 3/2017 Downing ..... E21B 43/127

* cited by examiner

MODULAR TOP LOADING DOWNHOLE PUMP WITH SEALABLE EXIT VALVE AND VALVE ROD FORMING APERTURE

CROSS-REFERENCE TO RELATED APPLICATIONS

This application claims priority to co-pending U.S. patent application Ser. No. 13/773,826, entitled Modular Top Loading Downhole Pump, filed Feb. 22, 2013, the entirety of which is incorporated herein by reference.

TECHNICAL FIELD OF THE INVENTION

The present invention relates generally to downhole pumps and, more particularly, but not by way of limitation, to downhole pumps in subterranean wells for moving fluids and slurries to the surface of the earth and for preventing gas lock. Methods of pumping fluids and of preventing gas-lock in downhole pumps are also provided.

SUMMARY OF THE INVENTION

The present invention is directed to a downhole pump positioned below the tubing string of a well. The pump comprises a body, at least one valve connectable with the body, the valve having first and second apertures, wherein fluids enter the at least one valve through the first aperture and exit the at least one valve through the second aperture and enter the body. The pump comprises a plunger moveable between an upper first position and a lower second position, wherein the upper first position is below the at least one valve. During plunger downstrokes, fluids enter the body and wherein during plunger upstrokes, fluids move up the tubing string. The pump comprises a sliding valve and a valve rod extending through the sliding valve, wherein fluids comprising gasses escape between the valve rod and the sliding valve.

The present invention is further directed to a system for pumping fluids in a well having a tubing string. The system comprises a body, at least one valve connectable with the body, the valve having first and second apertures, wherein fluids enter the at least one valve through the first aperture and exit the at least one valve through the second aperture and enter the body, and a plunger moveable between an upper first position and a lower second position, wherein the upper first position is below the at least one valve. During plunger downstrokes, fluids enter the body and wherein during plunger upstrokes, fluids move up the tubing string. The system comprises a sliding valve and a valve rod extending through the sliding valve, wherein fluids comprising gasses escape between the valve rod and the sliding valve.

The present invention is further directed to a method of preventing gas lock in a well comprising a tubing string. The method comprises the steps of intaking fluid via a valve positioned above a plunger within a barrel, moving the plunger between an upper first position and a lower second position, wherein the upper first position is below the valve, discharging fluid from the valve into a body positioned below the tubing string, moving the fluids up the tubing string on the upstroke of the plunger, and on the upstroke of the plunger, moving gasses between a sliding valve and a valve rod connectable to the plunger and extending through the sliding valve, thus preventing gas lock.

DETAILED DESCRIPTION OF THE INVENTION

Figure 1:
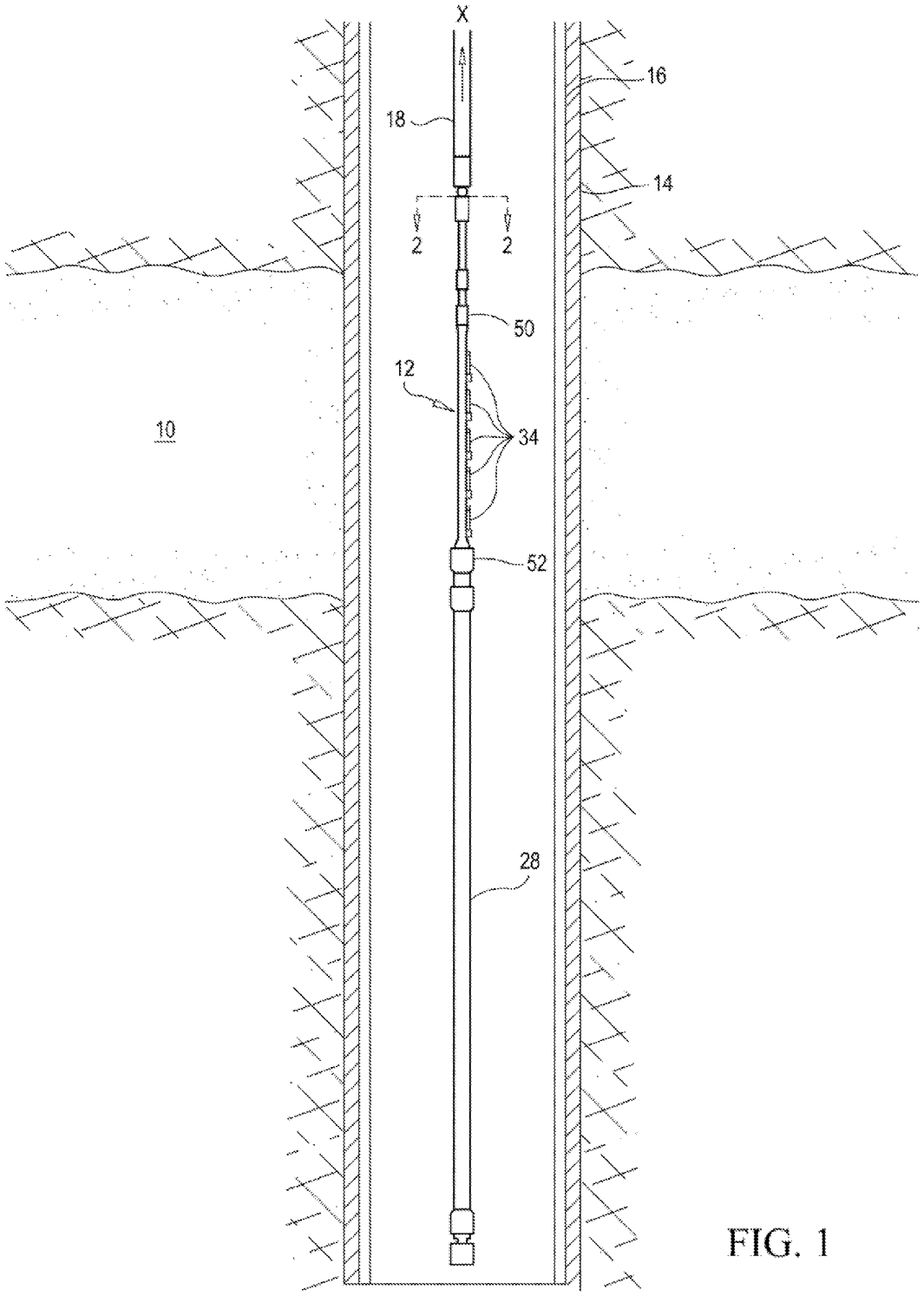
FIG. 1 is a schematic drawing of a borehole illustrating a well bore in which a tubing string is suspended and carries an exemplar of the downhole pump of the present invention.

The task of moving subterranean fluids, including oil, gas and slurries, from a reservoir to the surface of the earth requires a system of equipment that typically includes a downhole pump, often a reciprocating-type positive displacement pump, positioned within the borehole of the well. The downhole pump is connected, directly or indirectly, to a sucker rod string within the tubing in the borehole. The rod string cooperates with an artificial lift unit or pump jack that is powered by a prime mover, such as a combustion engine or electric motor. The sucker rod string moves up and down within the tubing in the borehole via motion of the artificial lift unit and transfers movement to the downhole pump.

Downhole positive displacement pumps of the reciprocating type often have a plunger within a barrel and a series of inlet and outlet valves for receiving and discharging fluid. The barrel is attached to the end of the tubing, and the plunger is attached to the sucker rod string. Reciprocating action of the plunger charges a cavity disposed between a traveling valve and a standing valve and lifts fluids through the tubing to the surface. Fluids flow into the pump through inlet valves on the suction, or up stroke, of the plunger as the cavity is expanding, and they are discharged through outlet valves on the discharge or down stroke as the cavity size decreases. Fluids discharged from the pump are forced up the tubing string to the wellhead where liquids and gases are separated and moved into production streams.

In conventional rod pumping systems, the standing valve is positioned at the bottom of the tubing, below the barrel and the plunger, while the traveling valve is positioned at the bottom of the sucker rod string and above the standing valve. On downstrokes of the plunger, the traveling valve is open and the standing valve is closed due to the weight of the fluid above it, which is moving upward through the open traveling valve, into the tubing, as the plunger moves downward. Conversely, on upstrokes, the traveling valve closes and fluids enter the barrel. As the plunger moves upward again, the available volume increases in the barrel between the standing valve and the traveling valve. When the plunger reaches the top of its stroke, the movement repeats downward again, and the traveling valve opens while the standing valve closes. Thus, conventional downhole pumps lift fluids up the tubing string on the downstroke of the plunger.

Problems can arise when gases are present. Some wells produce free gas, or gases entrained in liquid will come out of solution during production. If the produced fluid retains free gas, then the valves will not necessarily open or close at the top or bottom of the stroke. These gases may partially fill the cavity of the pump, displacing oil or other more desirable liquids, thereby adversely affecting the efficiency of the well. Additionally, the greater the volume of free gas, the greater the pumping action of the plunger is dedicated to expansion and compression of free gas rather than pumping fluids to the surface.

Moreover, gases may overtake the cavity of the pump, causing gas lock. Gases trapped between the inlet and outlet valves prevent the pump from achieving sufficient pressure to move fluids up the tubing string. When this happens, all valves are stuck in the closed position, and this holds the ball off seat, preventing fluid from moving through the pump or up the string to the surface. Concomitant losses in productivity occur. Efforts to eliminate gas lock sometimes occasion damage to the equipment and tools in the wellbore.

The downhole pump of the present invention overcomes problems associated with gas lock. Through a unique configuration, the plunger is positioned within a barrel below inlet valves in the pump. Inlet valves cooperate with a body positioned above the plunger and the barrel so that fluids enter the above the plunger and barrel. When the plunger moves up, intake fluids close off the valves and fluids are forced up the tubing string through a conventional slide valve that normally is used to connect the sucker rod string to the valve rod. This configuration elimates the need for outlet valves and eliminates gas lock in wells having a larger production levels.

The present invention further comprises a sealable exit valve in working cooperation with a valve rod that forms an aperture. The sealable exit valve forms a positive seal with the valve rod yet still allows the valve rod to move through the exit valve while allowing free and entrained gases to escape, thus preventing gas lock.

Furthermore, the present invention allows modularity of the pump components and offers benefits as the productivity of the well changes. An operator easily can alter the size of the barrel and the plunger to match modifications in production. For example, as well productivity decreases, the plunger and barrel can be replaced by smaller units that will pump fewer barrels in a given time period. Alternately, if enhanced recovery techniques cause the well to increase production, the modularity of the pump design of the present invention permits plunger and barrel to be easily interchanged with components matching higher production levels.

The modular design of the present invention also eases maintenance and decreases shut-in times and frequency. It is expected that mechanical parts, especially in moving systems, will break down or require maintenance. The unique configuration enables repair or replacement of valves, plunger, barrel, body and other parts without replacing the entire pump, resulting in lower maintenance costs and more efficient repair and shut-in times. These and other advantages of the present invention will be apparent from the following description of embodiments.

Turning now to the drawings in general, and to FIG. 1 in particular, there is shown therein a schematic of an earth formation 10 in which an exemplary downhole pump 12 of the present invention is shown suspended in a well 14. Casing 16 is cemented in place and serves to support the sides of the well 14. A tubing string 18 is suspended inside the casing 16 for returning fluids to the separation and production equipment at the surface of the well 14 and carries at its lower end the downhole pump 12. While FIG. 1 depicts a vertical well, it will be appreciated that the downhole pump of the present invention is suitable for use in deviated and horizontal wells, as well. Moreover, the downhole pump 12 of the present invention is suitable for use to pump a variety of fluids. As used herein, fluids include gases, oils, vapors, viscous substances, heavy oils, water, slurries, cements and muds.

Figure 2:
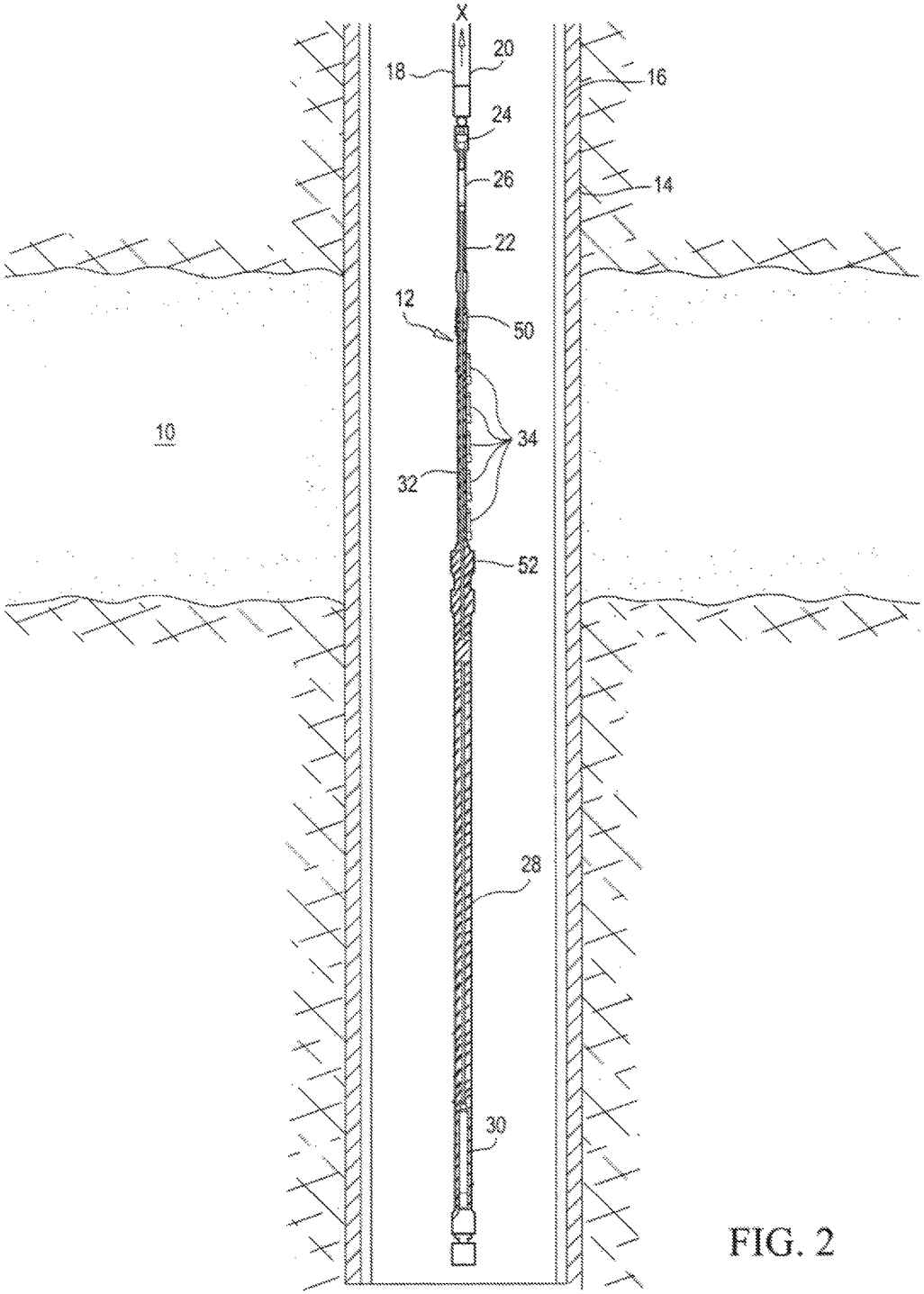
FIG. 2 is a cross-sectional view of the downhole pump of FIG. 1 taken along line 2-2.

Turning now to FIG. 2, there is shown a cross-section of the downhole end of the wellbore 10 of FIG. 1. A sucker rod string 20 connects downhole pump 12 to a pump jack, artificial lift unit or other reciprocating driver at the earth's surface, as is known in the art. Sucker rod string 20 is connected to valve rod 22 via valve rod adapter 24 and slide valve 26.

In one embodiment of the invention, slide valve 26 permits the flow of fluids from the pump 12 into the tubing string 18. As the pump jack moves up and down, the sucker rod string 20 moves valve rod 22, which reciprocate within the pump 12. The valve rod 22 extends through the slide valve 26 and connects with components in the pump. Fluids enter the pump 12 in a manner yet to be described and move up the tubing string in the direction of arrow x. In this embodiment of the invention, the slide valve 26 acts as an exit valve for free gas or gases entrained in produced fluids. Fluids can seep between the two components, valve rod 22 and slide valve 26, into the pump 12. The amount of fluid that seeps between the valve rod 22 and slide valve 26 may vary due to the measured tolerance between these two components, the hydrostatic pressure exerted by the produced fluid, the produced fluid type, the depth of the well, the strokes per minute of the pumping unit and other factors. As the volume of the fluids seeped approaches the designed pumping volume of the pump 12, the efficiency of the pump will decrease.

Figure 3:
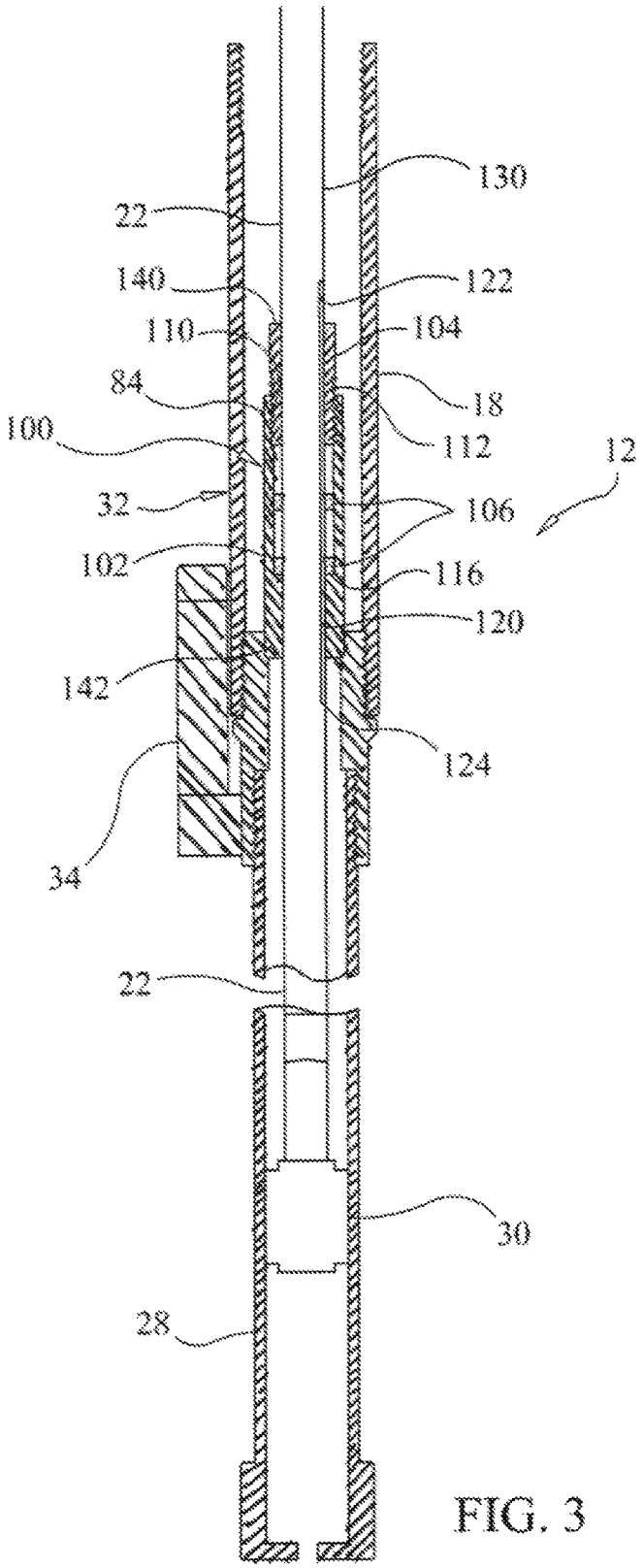
FIG. 3 is a cross-sectional view of an alternative embodiment of the present invention and illustrates an exemplary embodiment of a sealable exit valve used in conjunction with a valve rod for sealing engagement therewith, the valve rod forming an aperture for release of fluids.
Figure 3A:
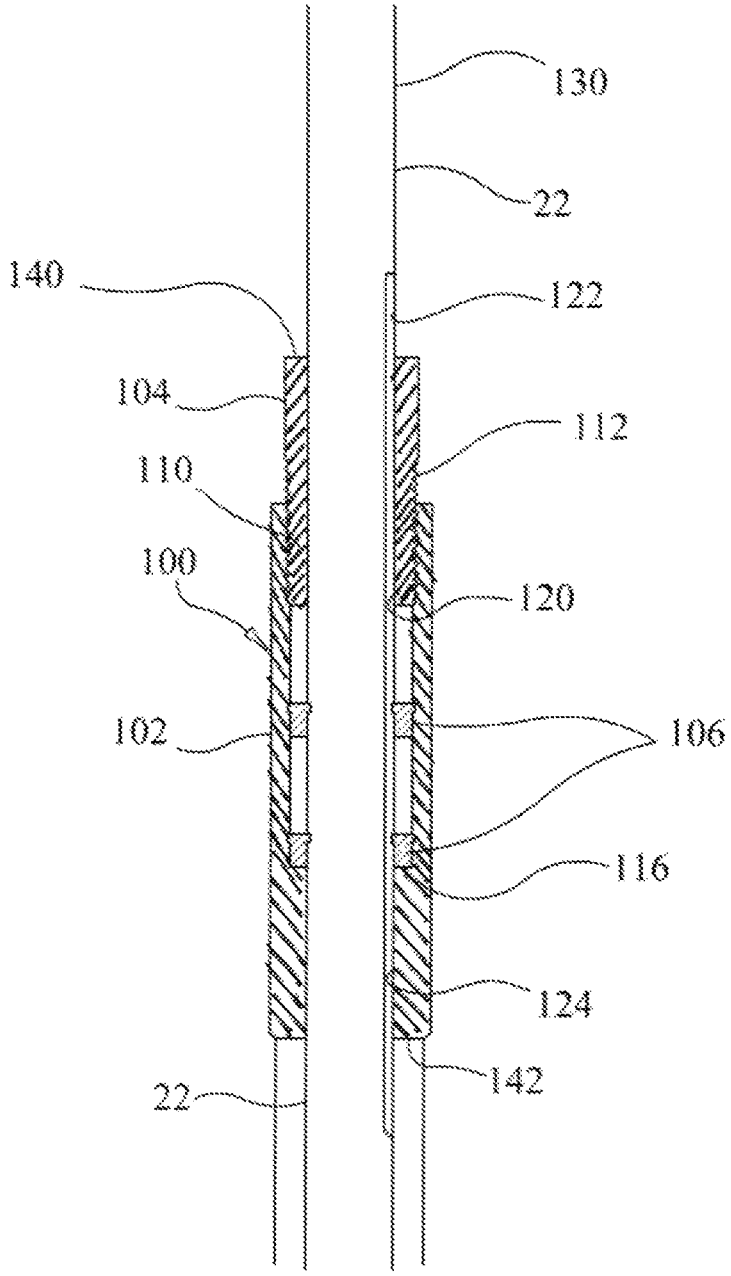
FIG. 3A is a close up of the cross-sectional view of the sealable exit valve of FIG. 3.

In wells that produce fluids at rates of less than about 300 bbl/day, or if the tolerance between the valve rod 22 and slide valve 26 is excessive, for example, but without limitation, tolerances greater than about 0.005 inches, a different mechanism may be employed to prevent gas locking. Turning now to FIGS. 3 and 3A, there is shown therein an alternative embodiment of the invention in which slide valve 26 is replaced with a sealable exit valve 100. In order maintain the efficiency of the pump 12 in wells producing less than about 300 bbl/day, the slide valve 26 may replaced with a sealable exit valve 100 that forms a positive seal with the valve rod 22.

The exit valve 100 comprises an exit valve body 102, a nut 104 and one or more seals 106 to engagingly seal with the valve rod 22. The exit valve body 102 may made be of any material suitable for use downhole, including steel, chrome, steel chrome-plated, steel with nickel/silicon carbide composite coating, brass, brass-chrome plated, brass with nickel/silicon carbide composite, stainless steel, stainless chrome-plated, stainless with nickel/silicon carbide composite coating, carbonitrided steel, nickel carbide plated steel, tempered steel and polyvinylchloride. It will be appreciated that the exit valve body 102 may be produced from other materials suited to the particular temperatures, pressures, fluids, and other conditions at the well 14 where in use. The diameter and length of the exit valve body 102 are variable and depend upon the size of the well 14, the diameter of the casing 16, the size and diameter of the barrel 28 and the plunger 30 and the quantity of production from the well, for example.

The nut 104 engages with the exit valve body 102. In one embodiment of the invention, the nut 104 is a flange nut and threadably engages with the exit valve body 102 via threads 110 and 112, shown in FIGS. 3 and 3A. It will appreciated that the exit valve body 102 and nut 104 may be adapted for engagement in a variety of ways other than with threading. For example, exit valve body 102 may form geometric configurations that receive or are received in alignment with matching geometric configurations in the nut 104. Various methods known in the art for connecting components in wells, such as collars, couplings, geometric connections or threaded connections, may be used to connect the exit valve body 102 with the nut 104. Additionally, it will be appreciated that the exit valve 100 may be a unitary, integrally-formed component.

The nut 104 may made be of any material suitable for use downhole, including steel, chrome, steel chrome-plated, steel with nickel/silicon carbide composite coating, brass, brass-chrome plated, brass with nickel/silicon carbide composite, stainless steel, stainless chrome-plated, stainless with nickel/silicon carbide composite coating, carbonitrided steel, nickel carbide plated steel, tempered steel and polyvinylchloride. It will be appreciated that the nut 104 may be produced from other materials suited to the particular temperatures, pressures, fluids, and other conditions at the well 14 where in use. The diameter and length of the nut are variable and depend upon the size of the exit valve body 102, the size of the well 14, the diameter of the casing 16, the size and diameter of the barrel 28 and the plunger 30 and the quantity of production from the well, for example.

The seal 106 is receivable at a seat or shoulder 116 formed in exit valve body 102. It will be appreciated that multiple seals may be used in the exit valve 100 and that not all seals necessarily must abut the seat or shoulder 116. A spacer, not shown, may be employed between the shoulder 116 and seal 106. Some examples of suitable seals 106 useful in the invention include mechanical seals and tolerance seals. Seals 106 may be may made be of any material suitable for use downhole, including nitrile, urethane, neoprene, fluorosilicone, nilrile, polyurethane, FEP, polyacrylate, silicone and other elastomers and fibers.

In this embodiment of the invention shown in FIGS. 3 and 3A, it will be noted that the exit valve 100 does not comprise a ball and seat, as does a conventional traveling valve, thus permitting the valve rod 22 to extend through the length of the pump 12 and engage with pump components in a manner yet to be described.

With continuing reference to FIGS. 3 and 3A, an aperture 120 is formed in valve rod 22. The aperture 120 may take any shape which will permit escape of gasses. Variation of width, depth, length and shape of the aperture 120 in valve rod 22 may be necessary or useful based on well parameters and other factors. In one embodiment of the invention, the aperture 120 forms a rectangle or an oval and ranges from about 0.125 inches wide to about 0.125 inches deep. The length of the aperture 120 may be longer than the length of the exit valve 100. In one embodiment of the invention, the length of the aperture 120 ranges from about 10 to about 200 inches long. In another embodiment of the invention, the aperture 120 is about 30 inches long. The exit valve 100 works in conjunction with the valve rod 22 forming aperture 120 to allow free and entrained gases to escape in a manner yet to be described and, thus, prevent gas lock.

With continuing reference to FIGS. 1, 2 and 3, in one embodiment of the present invention, the downhole pump comprises a barrel 28, a plunger 30, a body 32 positioned above the barrel and plunger, and a plurality of valves 34. The valve rod 22 runs through length of the pump 12 and attaches to the plunger 30 in the barrel 28. The barrel 28 may be any conventional barrel and may made be of any material suitable for use downhole, including steel, chrome, steel chrome-plated, steel with nickel/silicon carbide composite coating, brass, brass-chrome plated, brass with nickel/silicon carbide composite, stainless steel, stainless chrome-plated, stainless with nickel/silicon carbide composite coating, carbonitrided steel, nickel carbide plated steel, tempered steel and polyvinylchloride. It will be appreciated that the barrel 28 may be produced from other materials suited to the particular temperatures, pressures, fluids, and other conditions at the well 14 where in use. The diameter and length of the barrel 28 are variable and depend upon the size of the well 14, the diameter of the casing 16, the size and diameter of the plunger 30 and the quantity of production from the well, for example. The length of the barrel 28 generally ranges from at least about 6 to at least about 60 feet, while the diameter of the barrel generally ranges from at least about 1 and 1/16 inches to at least about 7 and 3/4 inches. References herein to diameters are to inside diameters, unless specifically stated to reference an outer diameter. It will be appreciated, however, that the barrel may be any diameter and length suited for conditions at the well where in use. The barrel 28 preferably, though not necessarily, complies with American Petroleum Institute (API) quality standards and dimensions. Barrels suitable for use in the invention are produced by Harbison-Fischer and Scot Industries, among others.

The plunger 30 is a reciprocating plunger connectable to valve rod 22 and may be made of any material suitable for use downhole, including carbon, steel, chrome and spray coated metal and is adapted for use in corrosive and abrasive conditions. It will be appreciated that the plunger 30 may be produced from other materials suited to the particular temperatures, pressures, fluids, and other conditions at the well 14 where in use. The diameter and length of the plunger 30 are variable and depend upon the size of the well 14, the diameter of the casing 16, the size and diameter of the barrel and the amount of production from the well, for example. It will be appreciated that the plunger 30 may be produced from other materials suited to the particular temperatures, pressures, fluids, and other conditions at the well 14 where in use. The diameter and length of the plunger 30 are variable and depend upon the size of the well 14, the size of the barrel 28, and the quantity of production from the well, for example. The length of the plunger 30 generally ranges from at least about 2 to at least about 50 feet, while the diameter of the plunger generally ranges from about 1 inch to about 7 inches. It will be appreciated, however, that the plunger 30 may be any diameter and length suited for conditions at the well where in use. The plunger 30 preferably, though not necessarily, complies with American Petroleum Institute (API) quality standards and dimensions. Plungers suitable for use in the invention are produced by Norris, Harbison-Fischer and Cameron, among others.

Figure 4:
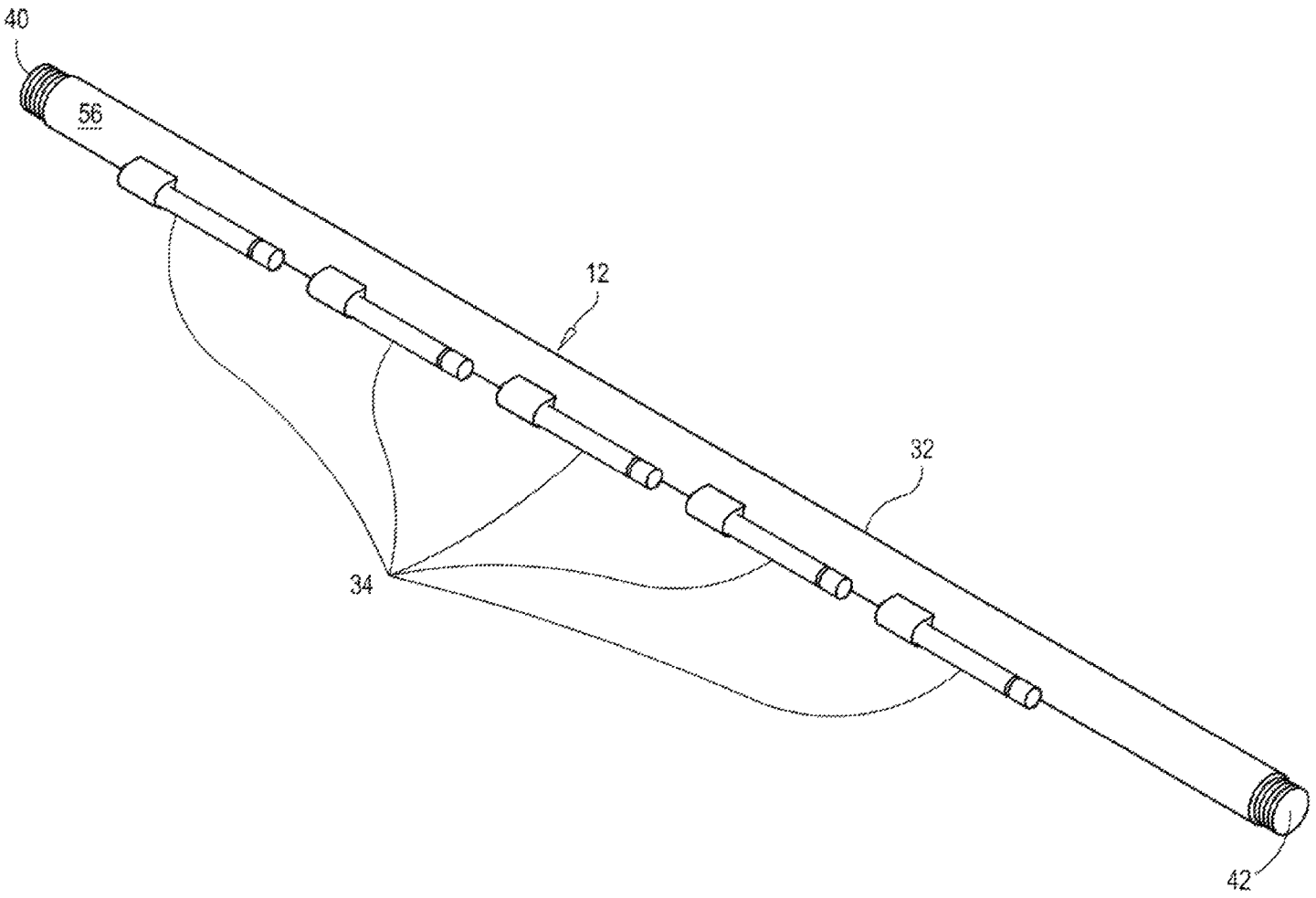
FIG. 4 is a perspective view of the body of an exemplar of the downhole pump of the present invention.

Turning now to FIG. 4, the downhole pump 12 comprises a body 32 connected to tubing string 18. The body 32 comprises at least one valve or a plurality of valves 34 positioned above the barrel 28 and plunger 30 in the well 14. The body 32 may be of any material suitable for use downhole, including steel, chrome, chrome-plated steel, steel with nickel/silicon carbide composite coating, brass, brass-chrome plated, brass with nickel/silicon carbide composite, stainless steel, stainless chrome-plated, stainless with nickel/silicon carbide composite coating, carbonitrided steel, nickel carbide plated steel, tempered steel and polyvinylchloride. It will be appreciated that the body 32 may be produced from other materials suited to the particular temperatures, pressures, fluids, and other conditions at the well 14 where in use. While the shape of body 32 may be any shape configured to fit downhole, a tubular shape generally is preferred as it facilitates operation with other tools and equipment in the well 14. A steel tubing sub is easily adapted and suitable for use in the present invention. A standard pump barrel or other pipe also are adaptable for use in making the body 32 of the present invention.

The diameter and length of the body 32 are variable and depend upon the size of the well 14, the diameter of the casing 16, the size and diameter of the barrel 28 and the plunger 30, the quantity of production from the well, and the number of valves 34, for example. The length of the body 32 generally ranges from at least about 1 foot to at least about 60 feet, while the diameter of the body generally ranges from about 0.5 inches to at least about six feet. It will be appreciated, however, that the body 32 may be any diameter and length suited for conditions at the well where in use. Persons skilled in the art of pumping fluids will know how to size components for the conditions suited to a particular well.

In one embodiment of the invention, body 32 forms threaded ends 40 and 42 and is threadably receivable with couplings 50 and 52, shown in FIGS. 1 and 2. It will appreciated that the ends 40 and 42 of body 32 may be adapted for connection in the well 14 in a variety of ways, other than with threaded couplings. For example, body 32 may form geometric configurations at ends 40 and 42 that receive or are received in alignment with matching geometric configurations in connecting components. Various methods known in the art for connecting components in wells, such as collars, couplings, geometric connections or threaded connections, may be used to connect the body 32 with the barrel 30.

Figure 5:
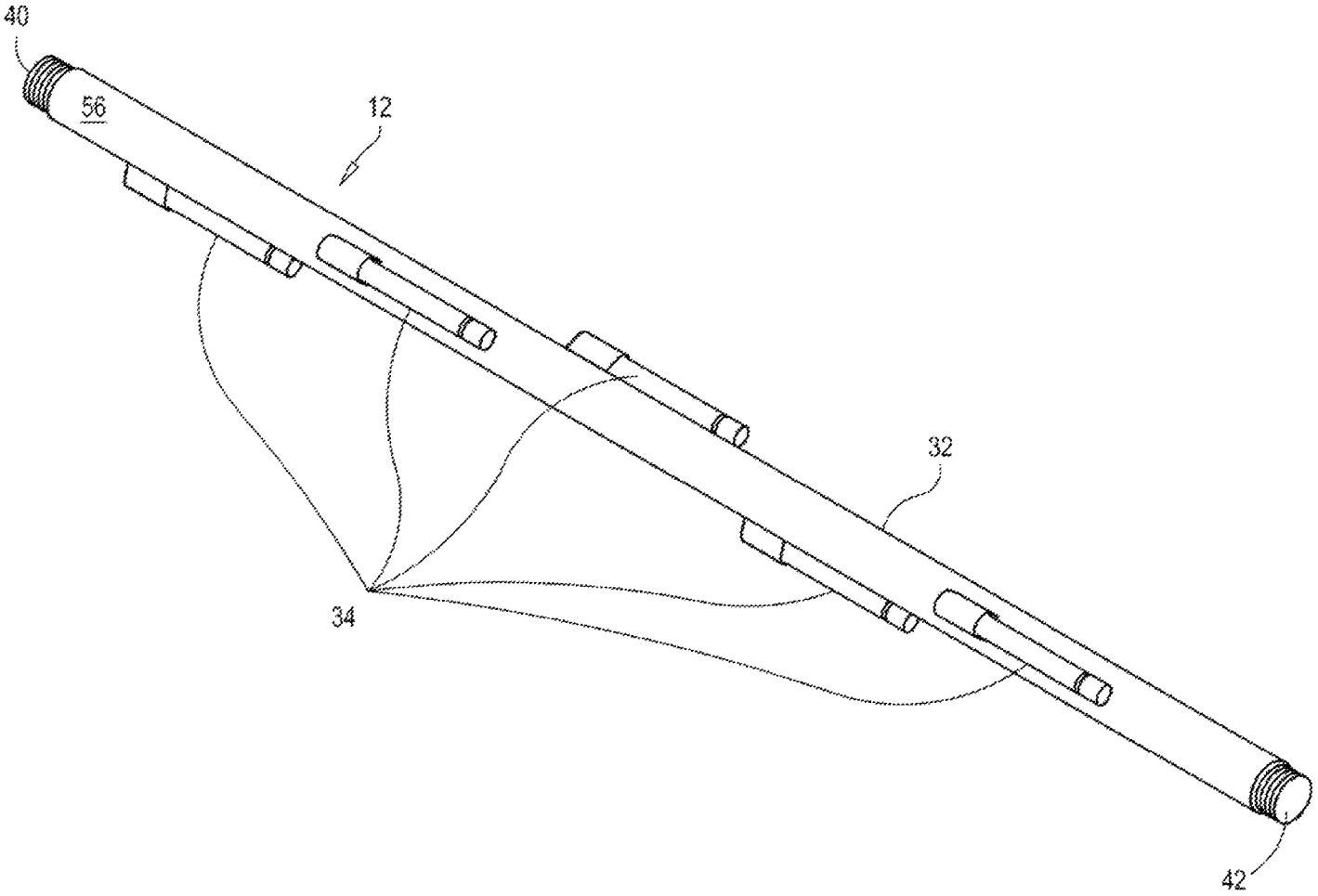
FIG. 5 is a perspective view of the body of an exemplar of the downhole pump of the present invention showing valves in alternating arrangement.
Figure 7:
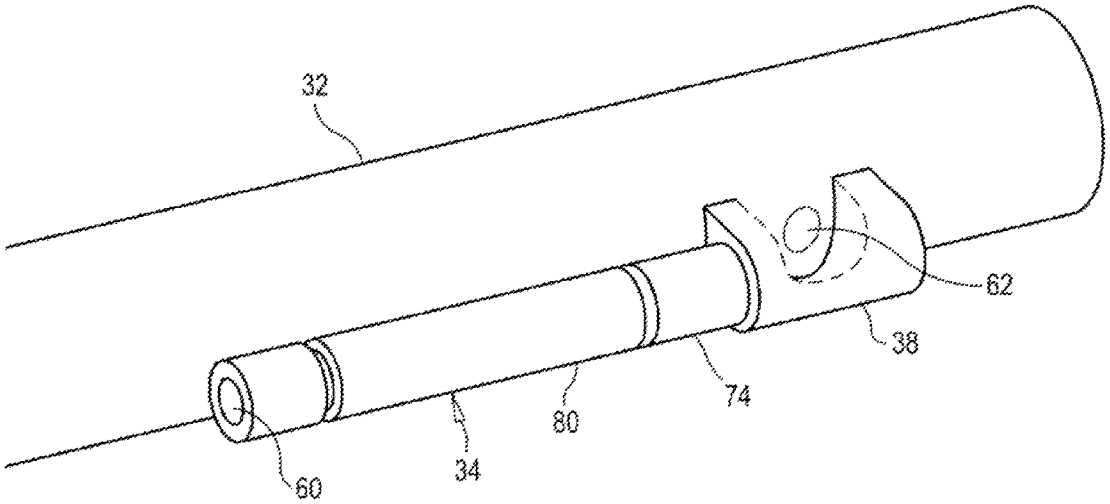
FIG. 7 is a perspective view of an exemplar of a valve suitable for use in the present invention, in partial cutaway.

With continuing reference to FIG. 4, the body 32 forms an exterior surface 56 adapted to receive at least one valve or a plurality of valves 34. It will be appreciated that valves 34 may be positioned on the exterior surface 56 of body 32, or the valves may be at least partially recessed in the body. One advantage of partially recessing the valves 34 in the body 32 is to minimize the overall outer diameter of the body and enables use in smaller wells. The number of valves 34 associated with the body 34 is unlimited. Valves 34 may be situated at any location on body 32. For example, valves 34 may be situated linearly in one side of body 32, as shown in FIG. 4. Alternately, and as additional examples, valves 34 may be positioned helically around the exterior surface 56 of body 32, as shown in FIG. 5, or spaced alternately on opposite sides of the body 32, as shown in FIG. 7. Additionally, the valves 34 may be positioned equatorially around the body 32. It is important to bear in mind that the number and positioning of valves 34 depends in part on the size of the body 32, the tubing 18 and the casing 14, the productivity of the well, the configuration of the producing earth formation 10 and the location of perforations in the well 14. Positioning valves 34 on one side of the body 32 minimizes the overall outer diameter of the body and enables use in smaller wells, while increasing production, even with smaller equipment and casings.

Valve 34 is connectable to body 32 via connector 38. The connector 38 may be made of any material suitable for use downhole, including steel, chrome, chrome-plated steel, steel with nickel/silicon carbide composite coating, brass, brass-chrome plated, brass with nickel/silicon carbide composite, stainless steel, stainless chrome-plated, stainless with nickel/silicon carbide composite coating, carbonitrided steel, nickel carbide plated steel, tempered steel and polyvinylchloride. It will be appreciated that the connector 38 may be produced from other materials suited to the particular temperatures, pressures, fluids, and other conditions at the well 14 where in use. While the shape of valve 38 may be any shape configured to fit downhole, a tubular shape generally is preferred as it facilitates operation with other tools and equipment in the well 14.

Connector 38 may be partially recessed in body 32 to enable the valve to sit closely to the exterior surface 58 of the body, creating a smaller overall dimension of the body and enabling use in smaller casing 14. Connector 38 may be welded to body 38, as in one embodiment of the invention, although it will be appreciated that connector 38 may be secured, joined or affixed to body 32 by any known means.

Figure 6:
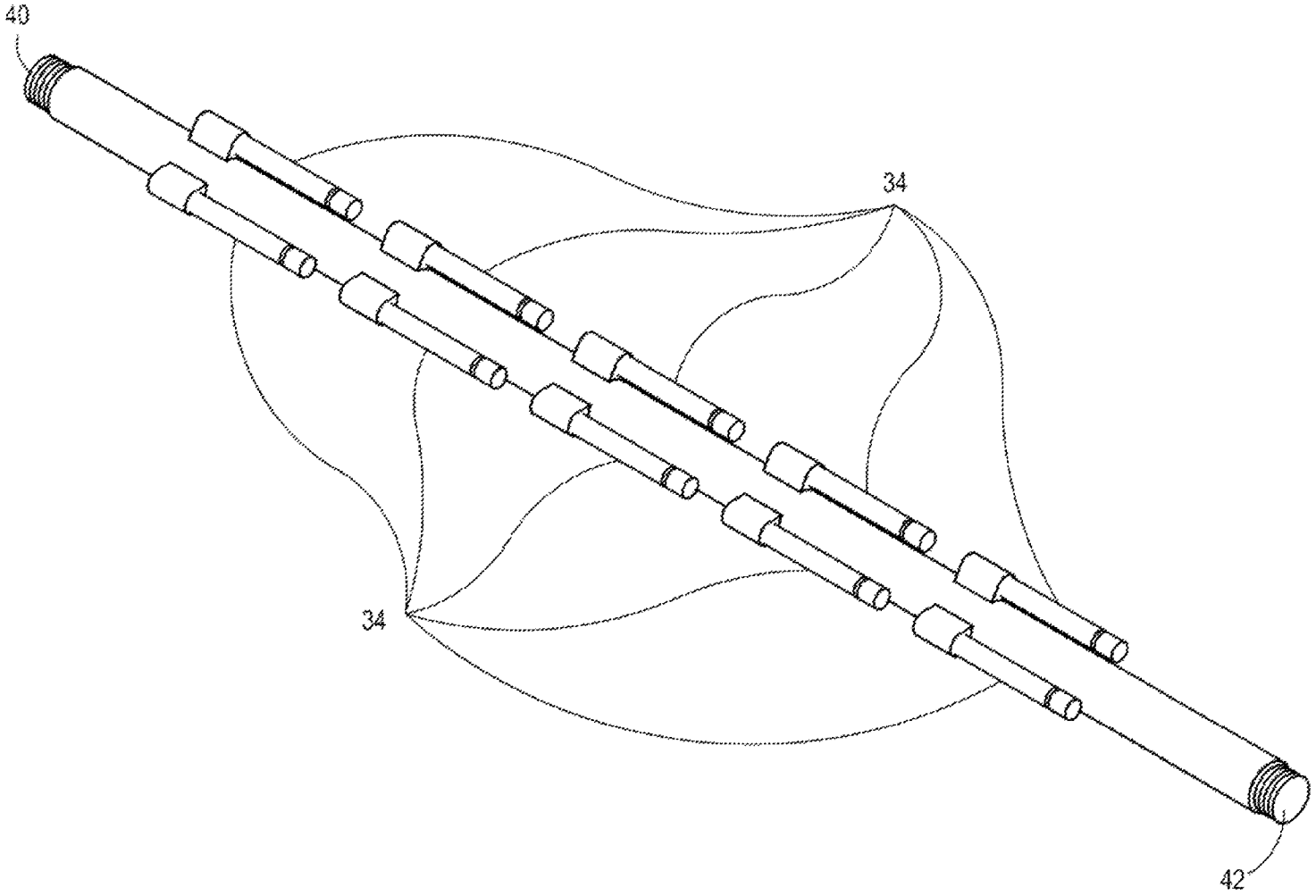
FIG. 6 is a perspective view of the body of an exemplar of the downhole pump of the present invention showing valves in helical arrangement.
Figure 8:
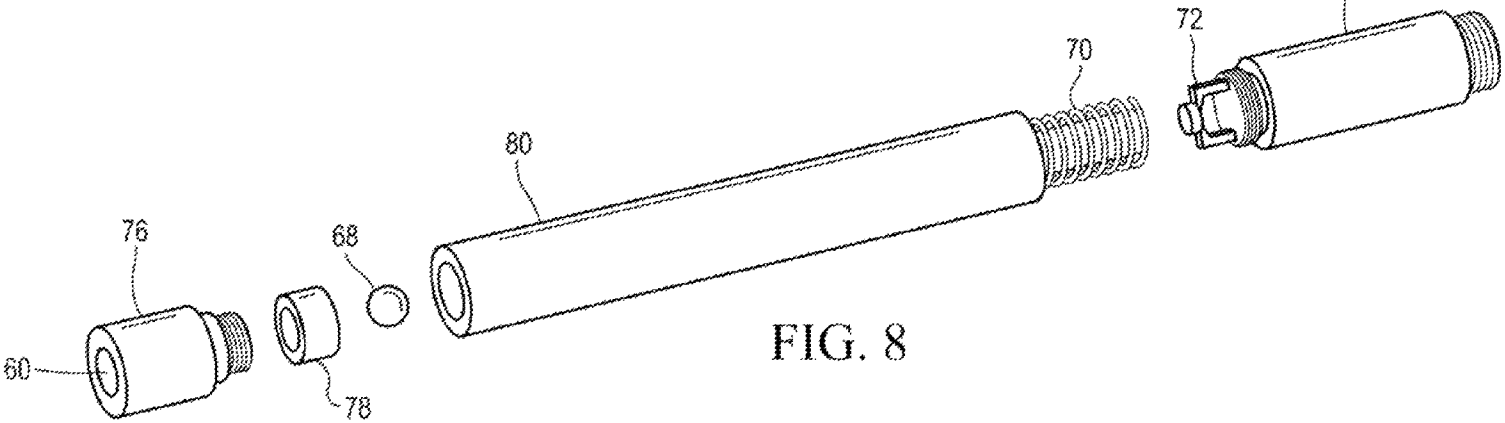
FIG. 8 is an exploded view of the valve shown in FIG. 7.

Turning now to FIGS. 7 and 8, valve 34 is shown secured to body 32 via connector 38 and comprises a first aperture 60 through which fluids enter the valve. Fluids exit valve 34 through connector 38 and enter the body 32 through a second aperture 62 in the body for transport up the tubing string 18 in the direction of arrow x. Valve 34 may be a variety of different types of valves, including ball check valves, diaphragm check valves, swing check valves, tilting disc check valves, stop check valves, lift check valves, and in-line check valves. In one embodiment of the invention, shown in exploded view in FIG. 6, the valve 34 is a ball check valve comprising a ball 68, seated on spring 70, receivable with, in or over seated plug 72. The seated plug 72 is housed in first housing 74, which is receivable in or adapted for connection with connector 38 on body 32. The valve 34 is capped at the opposite end by cap 76, which forms aperture 60, and nut 78, which connect with second housing 80 over ball 68 and spring 70.

In operation of the invention, when the plunger 30 reciprocates up, in the direction of arrow x, fluid moves the ball 68 on top of the seated plug 72. Spring 70 holds ball 68 against seat 72 and seals the off fluid flow into the body 32 through aperture 62. Because the body 32 and valves 34 are positioned above the plunger 30, the upstroke of reciprocating plunger 30 forces fluids to move up through the body 32 into the tubing 18 and to the surface of the well 14 toward the surface equipment or the sales line. On the downstroke of reciprocating plunger 30, the ball 68 is unseated and fluids entering through aperture 60 again may exit the valve 34 and enter the body 32 through aperture 62. It now will be appreciated that valves 34 operate as inlet valves for intaking fluids from well 14 into body 32 and that the unique configuration of pump 12 eliminates the need for outlet valves. Fluids exit the body 32 and enter the tubing string 18 through slide valve 26.

Thus, it now apparent that the pump 12 moves fluid up the tubing 18 to the surface on the upstroke of the plunger. The pump 12 and sliding valve 26 may be combined in operation with a conventional traveling valve and standing valve, which move fluids on the downstroke of a plunger. This will enable the plunger 30 to move fluids up the tubing 18 both on the upstroke and the downstroke of the plunger 30, thus, effectively multiplying the efficiency and productivity of the well 14. The combination may also require the use of a pull tube or hollow rod as a valve rod 22.

It further will be appreciated how the unique configuration of the downhole pump of the present invention prevents gas lock. During normal pump operation and when placed in wells that produce fluids in excess of 300 bbl/day, the mechanism that prevents gas lock is provided by seepage of the fluids being pumped, in both liquid and gaseous form, between the valve rod 22 and the slide valve 26. The measured tolerances between a conventional slide valve 26 and valve rod 22 can range from about 0.001 to about 0.025 of an inch, or more. If gas becomes trapped within the body 32 above the plunger 30, the tolerance between the two components will either allow the gas to seep upwards past the slide valve 26 into the tubing 18 and/or to match the hydrostatic pressure exerted by the fluids within the tubing 18 above the slide valve 26.

In wells that produce fluids at rates of less than 300 bbl/day, or if the tolerance between the valve rod 22 and slide valve 26 are found to be excessive, an alternative embodiment may be employed to prevent gas locking. As stated above, the amount of fluid that seeps between the valve rod 22 and the sliding valve 26 components may vary due to the measured tolerance between these components, the hydrostatic pressure exerted by the produced fluid, the strokes per minute of the prime mover and other factors. As the volume of fluids that seep back into the pump 12 through the valve rod 22 and slide valve 26 approaches the designed pumping volume of the pump, the efficiency of the pump will decrease.

In these cases, it has been found that the sealable exit valve 100, in conjunction with the valve rod 22 forming aperture 120 prevents gas lock. Returning to s 3 and 3A, the aperture 120 has an upper end 122 and a lower end 124. The aperture 120 is formed towards an upper end 130 of the valve rod 22. The exit valve 100 also has an upper end 140 and a lower end 142. During pump 12 operation, and at or around the bottom of the downstroke of the plunger 30, the bottom end 124 of the aperture 120 passes through a bottom end 142 of the exit valve 100, while the top end 122 of the aperture 120 remains above the top end 140 of the exit valve 100, as shown in FIGS. 3 and 3A. The aperture 120, being longer than the exit valve 100, forms a passage between the body 32 of pump 12, above the plunger 30, and the fluids within the tubing 18 above the exit valve 100. This channel allows any gas trapped within the body 32 above the plunger 30 to move upwards, past the exit valve 100 into the tubing 18 and/or to match the hydrostatic pressure exerted by the fluids within the tubing 18 and above the exit valve 100, thus preventing gas lock.

The present invention permits modularity of the components of the pump 12. An operator easily can change out the barrel 28, plunger 30, body 32 valves 34, exit valve 100 or valve rod 22 when changes in production necessitate modifications in size of components or when maintenance is needed. Only one component need be substituted to alter the production of the well 14.

Example 1

The efficiency and utility of a pump constructed in accordance with the present invention is demonstrated by the following example. An operating well, drilled to a depth of at least 7800 feet, was selected that produced 360 bbl/day at 100% efficiency. A pump of the present invention was installed using a 2 inch diameter plunger and a body constructed of 2 and ¾ inch inside diameter tubing sub, 20 feet long, inside a barrel of 2 and ¼ inches diameter. The well was run for a period of 24 hours, during which time the well produced 16.4 bbl/hour using 5 strokes of the plunger per minute. The well produced an additional 31 bbl/day, increasing overall productivity 8.5% to 391 bbl/day and profitability of the well by approximately $3,000 per day.

Example 2

The efficiency and utility of the pump constructed in accordance with the present invention with exit valve and valve rod forming an aperture is demonstrated by the following example. A modular downhole pump with sealable exit valve and valve rod forming an aperture was tested in a completed well drilled to a depth of 5,820 feet. Prior to the test installation of the present invention, the subject well, over a period of four months, had produced a total of 60 barrels of fluid due to frequent episodes of gas locking of prior downhole pumps installed at the well. After the experimental test installation of the invention, the well is producing an average 28.33 bbl/day of fluid, and the pump has not gas locked at any time.

The present invention further is directed to a method of pumping fluids from a reservoir in a well comprising a tubing string 18. Fluids are drawn in via at least one inlet valve 34 positioned above a plunger 30 within a barrel 28. The fluids move up the tubing string in the direction of arrow x on the upstroke of the plunger 30. The productivity of the well 14 may be altered by changing the plunger 30 to a larger or smaller size, in length, diameter or both, or by changing the size of the barrel, in length, diameter or both. The at least one valve is employed in connection with a body 32 used in association with the barrel 28 and plunger 30. The productivity of the well also may be altered by increasing the number of, or the changing the configuration of, valves 34 employed with body 32 and positioned above the barrel 28 and plunger 30.

The present invention further is directed to a method of preventing gas lock in a well 14 comprising a tubing string 18. To prevent gas lock, fluids are drawn in via at least one inlet valve 34 employed with a body positioned above a plunger 30 within a barrel 28. Fluids enter body 32 through inlet valves 34 and exit the body 32 through slide valve 26 into tubing string 26. The unique configuration of pump 12 eliminates the need for outlet valves.

During normal pump operation, and when placed in wells that produce fluids in excess of about 300 bbl/day, the mechanism that prevents gas locking is provided by seepage of the fluids, in both liquid and gaseous form, between the valve rod 22 and the sliding valve 26. In the practice of the invention using slide valve 26 and valve rod 22 without an aperture, if gas becomes trapped within the body 32 above the plunger 30, the tolerance between the valve rod 22 and slide valve 26 will either allow the gas to seep upwards past the slide valve into the tubing 18 and/or allow it to match the hydrostatic pressure exerted by the fluids within the tubing above the slide valve.

Alternatively, exit valve 100, in conjunction with the valve rod 22 having aperture 120 may be used to prevent gas lock. The aperture 120 in valve rod 22 forms a passage between the body 32 of the pump 12, above the plunger 30, and the fluids within the tubing 18 above the exit valve 100. This channel allows gas trapped within the body 32 of the pump 12 above the plunger 30 to move upwards, past the exit valve 100 into the tubing 18. It also allows trapped gas to match the hydrostatic pressure exerted by the fluids within the tubing 18 and above the exit valve 100, thus preventing gas lock The unique configuration of pump 12 also eliminates gas lock. Fluids, including gases from the formation 10 or coming out of solution, are forced up the tubing string 18 on the upstroke of the plunger 30. These fluids cannot lock the plunger 30 since the plunger is positioned below the valves 34. Further, the fluids cannot lock the valves 34 since the valves are positioned above the plunger 30 and function as inlets.

It now will be appreciated that the present invention presents a new downhole pump having a unique configuration that places the valves above the plunger and barrel of the pump. This configuration forces fluids up through the tubing string 18 on the upstroke of the plunger 30 to the surface and prevents gas lock. The invention also present a unique exit valve which, in cooperation with a valve rod having an exit valve, permits free and entrained gasses to escape and further enhances the ability of the invention to prevent gas lock. The configuration is modular and allows easy replacement, maintenance or alteration of the components of the pump, including the barrel, plunger, body or valves. The configuration also increases productivity in a well when using smaller components.

The invention has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

We claim:

1. A downhole pump positioned below the tubing string of a well, the pump comprising:

a body;

at least one valve connectable with the body, the valve having first and second apertures, wherein fluids enter the at least one valve through the first aperture and exit the at least one valve through the second aperture and enter the body;

a plunger moveable between an upper first position and a lower second position, wherein the upper first position is below the at least one valve;

wherein during plunger downstrokes, fluids enter the body and wherein during plunger upstrokes, fluids move up the tubing string;

a sliding valve; and a valve rod extending through the sliding valve, wherein fluids comprising gasses escape between the valve rod and the sliding valve.

2. The downhole pump of claim 1 wherein the at least one valve is selected from the group consisting of ball check valves, diaphragm check valves, swing check valves, tilting disc check valves, stop check valves, lift check valves, and in-line check valves.

3. The downhole pump of claim 1 further comprising an exit valve, wherein the exit valve comprises a seal.

4. The downhole pump of claim 3 further comprising a valve rod, wherein the exit valve sealingly engages the valve rod and wherein the valve rod forms an aperture.

5. The downhole pump of claim 4 wherein:

the exit valve has a length, a top end and a bottom end;

the valve rod has an upper end and the aperture is formed towards the upper end of the valve rod;

the aperture in the valve rod has an upper end and a lower end and the aperture is longer than the exit valve; and on the downstroke of the plunger, the bottom end of the aperture passes through the bottom of the exit valve while the top end of the aperture remains above the top end of the exit valve so that the aperture forms a passage between the body and above the plunger, thereby allowing fluids comprising gasses to move upwards past the exit valve into the tubing.

6. The downhole pump of claim 1 further comprising a barrel, wherein the barrel is modular and the barrel is interchangeable with barrels of alternate size to adjust productivity of the well.

7. The downhole pump of claim 6 wherein the plunger is modular and the plunger is interchangeable with plungers of alternate size to adjust productivity of the well.

8. The downhole pump of claim 1 wherein the at least one valve is modular and is interchangeable with alternate valves.

9. The downhole pump of claim 1 where in the body is modular and is interchangeable with alternate bodies.

10. The downhole pump of claim 1 wherein the at least one valve comprises a plurality of valves that are arranged linearly on one side of the body.

11. The downhole pump of claim 1 wherein the at least one valve consists essentially of an inlet valve.

12. The downhole pump of claim 1 wherein the at least one valve comprises a plurality of valves arranged equatorially around the body.

13. The downhole pump of claim 1 further comprising a standing valve and a traveling valve so that fluids move up the tubing string on both the upstroke and the downstroke of the plunger.

14. A system for pumping fluids in a well having a tubing string, the system comprising:

a body;

at least one valve connectable with the body, the valve having first and second apertures, wherein fluids enter the at least one valve through the first aperture and exit the at least one valve through the second aperture and enter the body;

a plunger moveable between an upper first position and a lower second position, wherein the upper first position is below the at least one valve;

wherein during plunger downstrokes, fluids enter the body and wherein during plunger upstrokes, fluids move up the tubing string;

a sliding valve; and a valve rod extending through the sliding valve, wherein fluids comprising gasses escape between the valve rod and the sliding valve.

15. The system of claim 14 wherein the at least one valve is selected from the group consisting of ball check valves, diaphragm check valves, swing check valves, tilting disc check valves, stop check valves, lift check valves, and in-line check valves.

16. The system of claim 14 further comprising an exit valve, wherein the exit valve comprises a seal.

17. The system of claim 16 further comprising a valve rod, wherein the exit valve sealingly engages the valve rod and wherein the valve rod forms an aperture.

18. The system of claim 17 wherein:

the exit valve has a length, a top end and a bottom end;

the valve rod has an upper end and the aperture is formed towards the upper end of the valve rod;

the aperture in the valve rod has an upper end and a lower end and the aperture is longer than the exit valve; and on the downstroke of the plunger, the bottom end of the aperture passes through the bottom end of the exit valve while the top end of the aperture remains above the top end of the exit valve so that the aperture forms a passage between the body and above the plunger, thereby allowing fluids comprising gasses to move upwards past the exit valve into the tubing.

19. The system of claim 14 further comprising a barrel, wherein the barrel is modular and the barrel is interchangeable with barrels of alternate size to adjust productivity of the well.

20. The system of claim 19 wherein the plunger is modular and the plunger is interchangeable with plungers of alternate size to adjust productivity of the well.

21. The system of claim 14 wherein the at least one valve is modular and is interchangeable with alternate valves.

22. The system of claim 14 where in the body is modular and is interchangeable with alternate bodies.

23. The system of claim 14 wherein the at least one valve comprises a plurality of valves that are arranged linearly on one side of the body.

24. The system of claim 14 wherein the at least one valve consists essentially of an inlet valve.

25. The system of claim 14 wherein the at least one valve comprises a plurality of valves arranged equatorially around the body.

26. The system of claim 14 further comprising a standing valve and a traveling valve, wherein during plunger upstrokes fluids move up the tubing string.

27. A method of preventing gas lock in a well comprising a tubing string, the method comprising the steps of:

intaking fluid via a valve positioned above a plunger within a barrel; and moving the plunger between an upper first position and a lower second position, wherein the upper first position is below the valve;

discharging fluid from the valve into a body positioned below the tubing string;

moving the fluid up the tubing string on the upstroke of the plunger; and on the upstroke of the plunger, moving gasses between a sliding valve and a valve rod connectable to the plunger and extending through the sliding valve, thus preventing gas lock.

28. The method of claim 27 wherein the well further comprises an exit valve and a valve rod forming an aperture, the valve rod connectable to the plunger and extending through the exit valve, and wherein during upstrokes of the plunger, gasses escape between the sliding valve and the valve rod, thus preventing gas lock.

29. The method of claim 27 further comprising the step of moving fluid up the tubing string on the downstroke of the plunger.

* * * * *